US006990987B1

(12) United States Patent
Smith

(10) Patent No.: US 6,990,987 B1
(45) **Date of Patent: *Jan. 31, 2006**

(54) METHOD AND APPARATUS FOR CONTAINING CLEANING FLUIDS WHILE CLEANING HEAT EXCHANGER FIN TUBES

(76) Inventor: Gary Ray Smith, P.O. Box 1247, Odem, TX (US) 78370

( * ) Notice: Subject to any disclaimer, the term of this patent is extended or adjusted under 35 U.S.C. 154(b) by 0 days.

This patent is subject to a terminal disclaimer.

(21) Appl. No.: 11/056,653

(22) Filed: Feb. 11, 2005

Related U.S. Application Data

(60) Provisional application No. 60/544,478, filed on Feb. 12, 2004.

(51) Int. Cl.
*B08B 9/02* (2006.01)
*B08B 9/027* (2006.01)

(52) U.S. Cl. ..... 134/22.1; 134/22.12; 134/22.18; 134/24; 134/104.2; 134/186

(58) Field of Classification Search ..... 134/22.1, 134/22.11, 22.12, 22.18, 24, 104.2, 115 R, 134/166 R, 169 R, 170, 186, 115
See application file for complete search history.

(56) References Cited

U.S. PATENT DOCUMENTS 4,551,181 A * 11/1985 Stearman ..... 134/22.11
5,336,331 A * 8/1994 Jenkins ..... 134/22.11
5,499,639 A * 3/1996 Williams, Jr. ..... 134/7

* cited by examiner

*Primary Examiner*—Michael Barr
*Assistant Examiner*—Saeed Chaudhry
(74) *Attorney, Agent, or Firm*—George S. Gray

(57) ABSTRACT

Equipment and methods are provided for combining with a typical heat exchanger having numerous fin tubes, the combination allowing the containment of cleaning fluid used to clean fin tubes with high pressure liquid cleaning devices in which cleaning fluid is discharged into one end of each fin tube and out the other. An enclosure is attached to an opened end of a heat exchanger having U-shaped fin tubes, the enclosure having cleaning tool access portions for separately exposing each of at least two pluralities of the fin tubes entry ends, while continuing to cover the remaining fin tube pluralities, and the fin tube exit ends. Fluid splashed at the cleaning fluid entry end of the fin tubes and cleaning fluid exiting the fin tubes is captured and drained by the enclosure. Alternatively, a second enclosure captures exiting cleaning fluids in heat exchangers having straight fin tubes and two openable ends.

12 Claims, 11 Drawing Sheets

METHOD AND APPARATUS FOR CONTAINING CLEANING FLUIDS WHILE CLEANING HEAT EXCHANGER FIN TUBES

CROSS-REFERENCE TO RELATED APPLICATION

This application claims priority from U.S. Provisional Patent Application Ser. No. 60/544,478, filed Feb. 12, 2004, the inventor being Gary Ray Smith.

BACKGROUND OF THE INVENTION

1. Field of the Invention

The field of the invention is the petrochemical industry, and more particularly, the cleaning of fin tubes in heat exchangers.

2. Description of Related Art

The term "heat exchanger" as used herein refers to certain apparatus in common use in the petrochemical industry. Typically, a heat exchanger receives hot crude oil from a fractionating tower, the oil then being routed through the fin tubes. Boiler feed water is presented inside the exchanger in areas surrounding the fin tubes. The heat exchange between the hot crude oil and the boiler feed water provides steam and reduces the temperature of the crude oil, the cooler crude oil is then transferred from the heat exchanger for additional processing elsewhere. The drop in the crude oil temperature typically results in carbonate scale buildup within the fin tubes.

A first example of a prior art heat exchanger 10 (with fin tubes in a "U" configuration) is depicted in FIGS. 1–3, with FIG. 3 depicting a plan view of some of the fin tubes in the area of the "U," and FIG. 2 depicting a side view of the same area. In this type of heat exchanger, both ends of each fin tube are presented at the openable end of the exchanger, providing access for the insertion of the fluid discharge end of a typical high-pressure cleaning apparatus. A typical cleaning tool is a line mole having a flexible hose with a discharge tip. Such fin tube ends will typically be presented in a substantially uniform pattern across the opened end of the heat exchanger when viewed from the end. Cleaning fluid entering one end of a fin tube on the right side of the opened heat exchanger end will be discharged, along with discharged material, at the fin tubes' second end on the left side of the opened heat exchanger end.

A second example of a prior art heat exchanger 20 (with fin tubes in a straight configuration) is depicted in FIGS. 4–5. In this type of heat exchanger, the ends 22,23 of the heat exchanger can be removed to present one end of each fin tube at the first end 26 of the heat exchanger shell 28 (frame), and a second end of each fin tube at the second end 27 of the heat exchanger frame. Cleaning fluid discharged into a fin tubes first end, at the first end of the heat exchanger frame, will be discharged from the second end of the fin tube, at the second end of the heat exchanger.

The fin tubes in both heat exchangers 10,20 typically have one-half inch inside diameters. Each fin tube has exterior fins about its outside circumference, the fins being spaced by approximately one-sixteenth inch.

A significant operational, safety and regulatory concern related to the cleaning process for these types of heat exchangers is the cleaning fluid and dislodged material being discharged on to the surrounding equipment or the ground. Operators have attempted to isolate the area subject to splashing and exiting fluids and dislodged materials, by temporarily isolating and/or covering the area using sheets of plywood, etc. All current methods of controlling the splashing and exiting fluids and dislodged materials are labor and material intensive, making the process time consuming and expensive.

Equipment is needed that will install quickly and capture the splashing and exiting cleaning fluids and dislodged materials while the heat exchanger fin tubes are being cleaned.

SUMMARY OF THE INVENTION

My invention provides equipment that installs quickly and captures splashing and exiting cleaning fluids and dislodged materials while heat exchanger fin tubes are being cleaned using high pressures cleaning devices.

In some exemplary embodiments of my present invention, I have provided, for a heat exchanger to be cleaned by a cleaning apparatus having a fluid discharge end, a fluid containment apparatus for attachment to the heat exchanger, the heat exchanger having multiple fin tubes supported by and positioned within a substantially cylindrical frame, the frame having an openable and substantially circular end and each of the fin tubes being U-shaped and having a first end and a second end, such that each fin tube first end and second end is proximate the openable end when the frame is opened, the frame openable end having a removable end member for opening the frame openable end such that the cleaning apparatus fluid discharge end is insertable into one of the fin tube first ends, such that cleaning fluids discharged within the fin tube exits the fin tube's second end, the apparatus comprising: an enclosure having a frame, a flexible housing, and a drain member, the housing having an interior, the housing being supported by the frame, the housing being extendable over and attachable to the heat exchanger frame opened openable end, the housing having a plurality of access portions, each access portion being openable to expose a number of the fin tube first ends to cleaning apparatus fluid discharge end direct access and entry and cleaning fluid discharged from the cleaning apparatus fluid discharge end, the flexible housing substantially blocking such direct access and entry to the fin tube second ends corresponding to the exposed fin tube first ends, such access portion being closable to substantially block such direct access and entry to such exposed heat exchanger fin tube first ends, the flexible housing being attached such that cleaning fluid discharged from the second end of the fin tube into which the cleaning apparatus discharge end is inserted, is received by the housing and directed by the housing to the drain member.

In some exemplary embodiments of my present invention, the enclosure housing access portions are simultaneously openable such that all fin tube first ends are exposed.

In some exemplary embodiments of the invention, I have provided, for a heat exchanger to be cleaned by a cleaning apparatus having a fluid discharge end, the heat exchanger having multiple fin tubes supported by and positioned within a substantially cylindrical frame, the frame having an openable and substantially circular end and each of the fin tubes being U-shaped and having a first end and a second end, such that each fin tube first end and second end is proximate the openable end when the frame is opened, the frame openable end having a removable end member for opening the frame openable end such that the cleaning apparatus fluid discharge end is insertable into one of the fin tube first ends, such that cleaning fluids discharged within the fin tube exits the fin tube's second end, an apparatus for containing the discharged cleaning fluids comprising: means for enclosing the opened heat exchanger frame openable end while providing openable separate direct access and entry to each of at least two pluralities of the heat exchanger fin tube first end for the cleaning apparatus fluid discharge end to enter, the means substantially blocking such direct access and entry to the remaining fin tube first end pluralities during such direct access and entry to a first of the pluralities, and to the first of the pluralities during direct access and entry to a second of the pluralities, the means being attached such that cleaning fluid discharged from a fin tube first end and a fin tube second end is received by, and drained from, such means.

In some exemplary embodiments of my invention, the means for enclosing the opened heat exchanger frame openable end is optionally openable such that all fin tube first ends are exposed for direct access and entry by the cleaning apparatus fluid discharge end.

In some exemplary embodiments of my invention, I have provided, for a heat exchanger to be cleaned by a cleaning apparatus having a fluid discharge end, the heat exchanger having multiple fin tubes supported by and positioned within a substantially cylindrical frame, the frame having an openable and substantially circular end and each of the fin tubes being U-shaped and having a first end and a second end, such that each fin tube first end and second end is proximate the openable end when the frame is opened, the frame openable end having a removable end member for opening the frame openable end such that the cleaning apparatus fluid discharge end is insertable into one of the fin tube first ends, such that cleaning fluids discharged within the fin tube exits the fin tube's second end, a method for containing the discharged cleaning fluids comprising: enclosing the opened heat exchanger frame openable end with an enclosure; opening a first access portion of the enclosure to expose a first plurality of the fin tube first ends to cleaning apparatus fluid discharge end direct access and entry, and cleaning fluid discharged from the cleaning apparatus fluid discharge end, the enclosure substantially blocking such direct access and entry to at least one additional plurality of fin tube first ends; discharging cleaning fluid from the cleaning apparatus fluid discharge end into each of the first plurality of fin tube first ends, the enclosure capturing and draining cleaning fluid discharged from the fin tubes proximate the fin tube second ends and the first plurality fin tube first ends; closing the first access portion; opening a second access portion of the enclosure to expose a second plurality of the fin tube first ends to cleaning apparatus fluid discharge end direct access and entry, and cleaning fluid discharged from the cleaning apparatus fluid discharge end, the enclosure substantially blocking such direct access and entry to at least some of the first plurality of fin tube first ends; and discharging cleaning fluid from the cleaning apparatus fluid discharge end into the second plurality of fin tube first ends, the enclosure capturing and draining cleaning fluid discharged from the fin tubes proximate the fin tube second ends and the second plurality fin tube first ends.

In some exemplary embodiments of my invention, I have provided, for a heat exchanger to be cleaned by a cleaning apparatus having a fluid discharge end, a fluid containment apparatus for attachment to the heat exchanger, the heat exchanger having multiple fin tubes supported by and positioned within a substantially cylindrical frame, the frame having a substantially circular first end and second end, the fin tubes each having a first end and a second end, the frame first and second ends each having a removable end member such that the frame first and second ends are openable and such that the cleaning apparatus discharge end is insertable into one of the fin tube first ends, such that cleaning fluids discharged within the fin tube exits the fin tube's second end proximate the frame's opened second end, the apparatus comprising: a first enclosure having a frame, a flexible housing, and a drain member, the housing having an interior, the housing being supported by the frame, the housing being extendable over and attachable to the opened heat exchanger frame openable first end, the housing having a plurality of access portions, each access portion being openable to expose a number of the fin tube first ends to cleaning apparatus fluid discharge end direct access and entry and cleaning fluid discharged from the cleaning apparatus fluid discharge end, the flexible housing substantially blocking such direct access and entry to the remaining fin tube first ends, such access portion being closable to substantially block such direct access and entry to the such exposed fin tube first ends, the flexible housing being attached such that cleaning fluid discharged from a fin tube first end is received by the housing and directed by the housing to the drain member; and a second enclosure having a frame, a housing, and a drain member, the housing having an interior, the housing being supported by the frame, the housing being extendable over and attachable to the opened heat exchanger frame openable second end such that cleaning fluid exiting one or more of the fin tube second ends is received by the second enclosure housing and directed by the second enclosure housing to the drain member.

In some exemplary embodiments of my invention, the apparatus further comprises an access mechanism for providing access to the second enclosure housing interior, the access mechanism being openable and closable.

In some exemplary embodiments of my invention, the first enclosure housing access portions are simultaneously openable such that all fin tube first end holes are exposed.

In some exemplary embodiments of my invention, I have provided, for a heat exchanger to be cleaned by a cleaning apparatus having a fluid discharge end, the heat exchanger having multiple fin tubes supported by and positioned within a substantially cylindrical frame, the frame having a substantially circular first end and second end, the fin tubes each having a first end and a second end, the frame first and second ends each having a removable end member such that the frame first and second ends are openable and such that the cleaning apparatus discharge end is insertable into one of the fin tube first ends, such that cleaning fluids discharged within the fin tube exits the fin tube's second end proximate the frame's opened second end, an apparatus for containing the discharged cleaning fluids comprising: means for enclosing the opened heat exchanger frame openable first end while providing openable separate direct access and entry to each of at least two pluralities of the heat exchanger fin tube first ends for the cleaning apparatus fluid discharge end to enter, the means substantially blocking such direct access and entry to the remaining fin tube first end pluralities during such access and entry to a first of the pluralities, and to the first of the pluralities during direct access and entry to a second of the pluralities, the means being attached such that cleaning fluid discharged from a fin tube first end is received by, and drained from, such means; and means for enclosing the opened heat exchanger frame openable second end such that cleaning fluid exiting one or more of the fin tube second ends is received by, and drained from such means.

In some exemplary embodiments of my invention, the means for enclosing the opened heat exchanger openable second end has an interior, such means further comprising means for providing access to such interior, such means for providing access being openable and closable.

In some exemplary embodiments of my invention, the means for enclosing the frame first end is optionally openable such that all fin tube first ends are exposed for direct access and entry by the cleaning apparatus fluid discharge end.

In some exemplary embodiments of my invention, I have provided, for a heat exchanger to be cleaned by a cleaning apparatus having a fluid discharge end, the heat exchanger having multiple fin tubes supported by and positioned within a substantially cylindrical frame, the frame having a substantially circular first end and second end, the fin tubes each having a first end and a second end, the frame first and second ends each having a removable end member such that the frame first and second ends are openable and such that the cleaning apparatus discharge end is insertable into one of the fin tube first ends, such that cleaning fluids discharged within the fin tube exits the fin tube's second end proximate the frame's second end, a method for containing the discharged cleaning fluids comprising: enclosing the opened heat exchanger frame openable first end with a first enclosure; enclosing the opened heat exchanger frame openable second end with a second enclosure; opening a first access portion of the first enclosure to expose a first plurality of the fin tube first ends to cleaning apparatus fluid discharge end direct access and entry and cleaning fluid discharged from the cleaning apparatus fluid discharge end, the first enclosure substantially blocking such direct access and entry to at least one additional plurality of fin tube first ends; discharging cleaning fluid from the cleaning apparatus fluid discharge end into each of the first plurality of fin tube first ends, the first enclosure capturing and draining cleaning fluid discharged from the fin tubes proximate the first plurality fin tube first ends, the second enclosure capturing and draining cleaning fluid discharged from the fin tubes proximate the first plurality fin tube second ends; closing the first access portion; opening a second access portion of the enclosure to expose a second plurality of the fin tube first ends to cleaning apparatus fluid discharge end direct access and entry, and cleaning fluid discharged from the cleaning apparatus fluid discharge end, the enclosure substantially blocking such direct access and entry to at least some of the first plurality of fin tube first ends; and discharging cleaning fluid from the cleaning apparatus fluid discharge end into the second plurality of fin tube first ends, the first enclosure capturing and draining cleaning fluid discharged from the fin tubes proximate the second plurality fin tube first ends, the second enclosure capturing and draining cleaning fluid discharged from the fin tubes proximate the second plurality fin tube second ends.

DETAILED DESCRIPTION OF EXEMPLARY EMBODIMENTS

The following discussion describes in detail exemplary embodiments of the invention. This discussion should not be construed, however, as limiting the invention to those particular embodiments. Practitioners skilled in the art will recognize numerous other embodiments as well.

Figure 1:
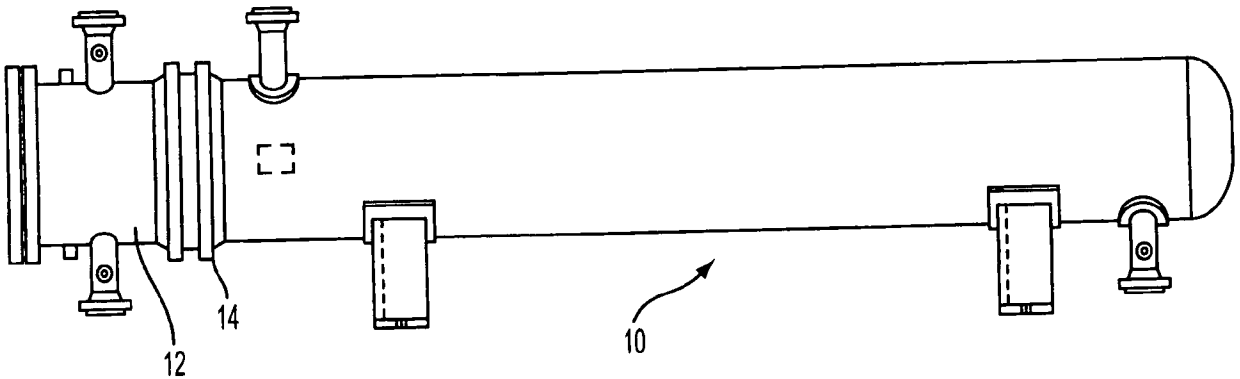
FIG. 1 (PRIOR ART)
FIG. 1 is a prior art heat exchanger of the type having fin tubes in a U-tube configuration.
Figure 2:
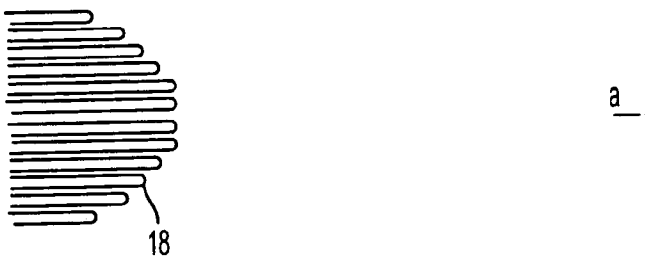
FIG. 2 (PRIOR ART)
FIG. 2 is a top view depicting a portion of certain fin tubes in a U-tube type heat exchanger.
Figure 3:
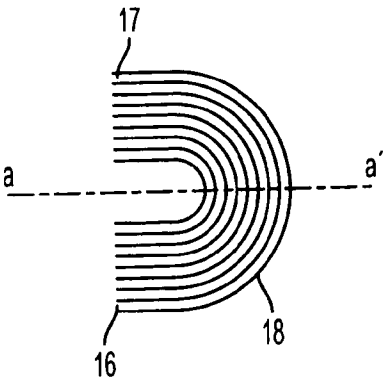
FIG. 3 (PRIOR ART)
FIG. 3 is a side view of the fin tube portion shown in FIG. 2.

Referring now to FIGS. 1–3, a heat exchanger of the type having fin tubes in a "U" configuration is shown to have a frame 11 and a frame end member 12 which is removable to present an openable end 14, wherein both the first ends 16 and second ends 17 of each of the fin tubes 18 are located. The cross-section of the exchanger frame openable end will be substantially filled with fin tube ends, including both the first and second ends of all fin tubes. FIGS. 1–3 and reference line a–a' reveal that the first ends will be in the right half of the frame, while the second ends will be in the left half of the frame.

Figure 6:
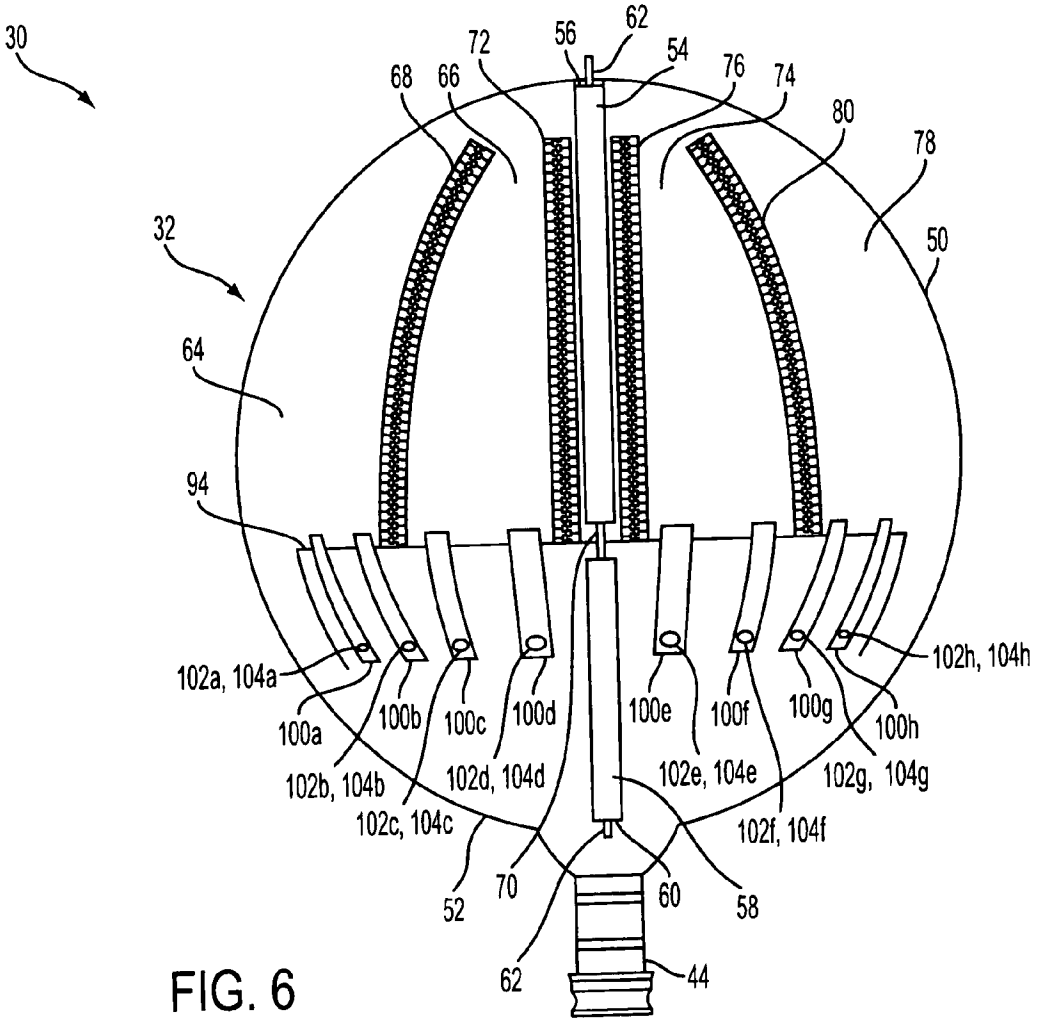
FIG. 6 is a front view of an exemplary embodiment of a first enclosure of the present invention.
Figure 7:
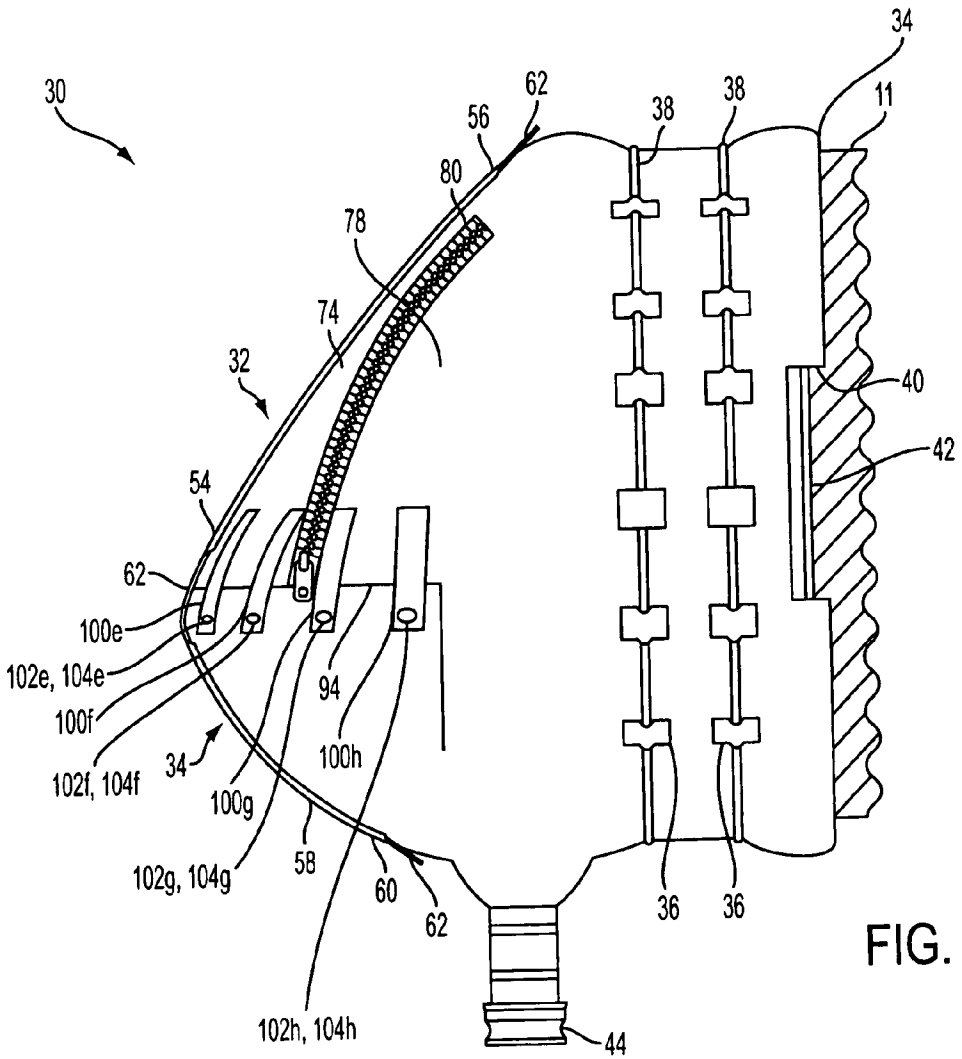
FIG. 7 is a side view of the enclosure of FIG. 6, shown attached to a heat exchanger.

FIGS. 6–12 depict an exemplary embodiment 30 of the current invention wherein the heat exchanger 10 is to be cleaned. An enclosure 32 is attached to the opened end 14 of the heat exchanger frame 11. The flexible enclosure has a rear edge 34, with loops 36 and ropes 38 positioned so as to circumvent the opened heat exchanger end. As shown in FIG. 7, the ropes are threaded through the loops, where they are drawn tight about the heat exchanger frame and tied off, substantially sealing the opened end of the frame. In this exemplary embodiment, and as further shown in FIG. 7, the rear edge of the enclosure has a sleeve 40 having a rope 42 therein that can be tightened in drawstring fashion to provide additional attachment integrity with respect to the heat exchanger openable end.

In the exemplary embodiment shown in FIG. 6, the enclosure 32 is shaped to direct any liquids within the enclosure to a drain 44.

The enclosure has a top portion 50 and a bottom portion 52, the top portion having a sheath 54 with open ends 56, and the bottom portion having a sheath 58 with open ends 60, the top and bottom portion sheathes being aligned for snug insertion of a flexible frame rod 62, through both sheathes.

Figure 9:
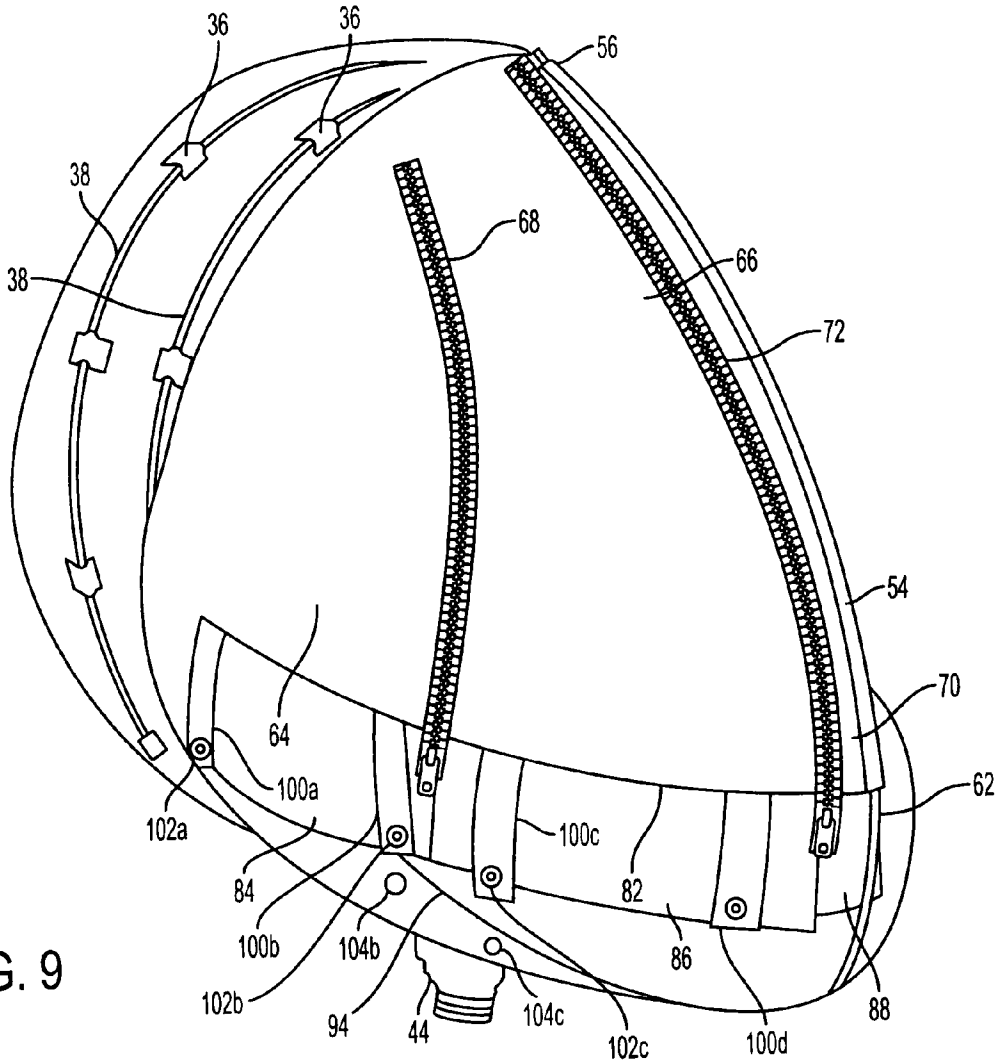
FIG. 9 is an oblique view of the enclosure of FIG. 8, with the enclosure bottom portion unfastened to reveal some of the enclosure top portion skirts.

As shown in FIGS. 6 and 9, the top portion 50 has fin tube access provided through openable sections, including a first section 64, a second section 66, a first zipper 68 connecting the first section and the second section, a center section 70, a second zipper 72 connecting the second section and the center section, a third section 74, a third zipper 76 connecting the center section and the third section, a fourth section 78, and a fourth zipper 80 connecting the third section to the fourth section. When fully zipped such sections combine to form a continuous covering having a lower edge 82, as shown in FIG. 9.

Figure 11:
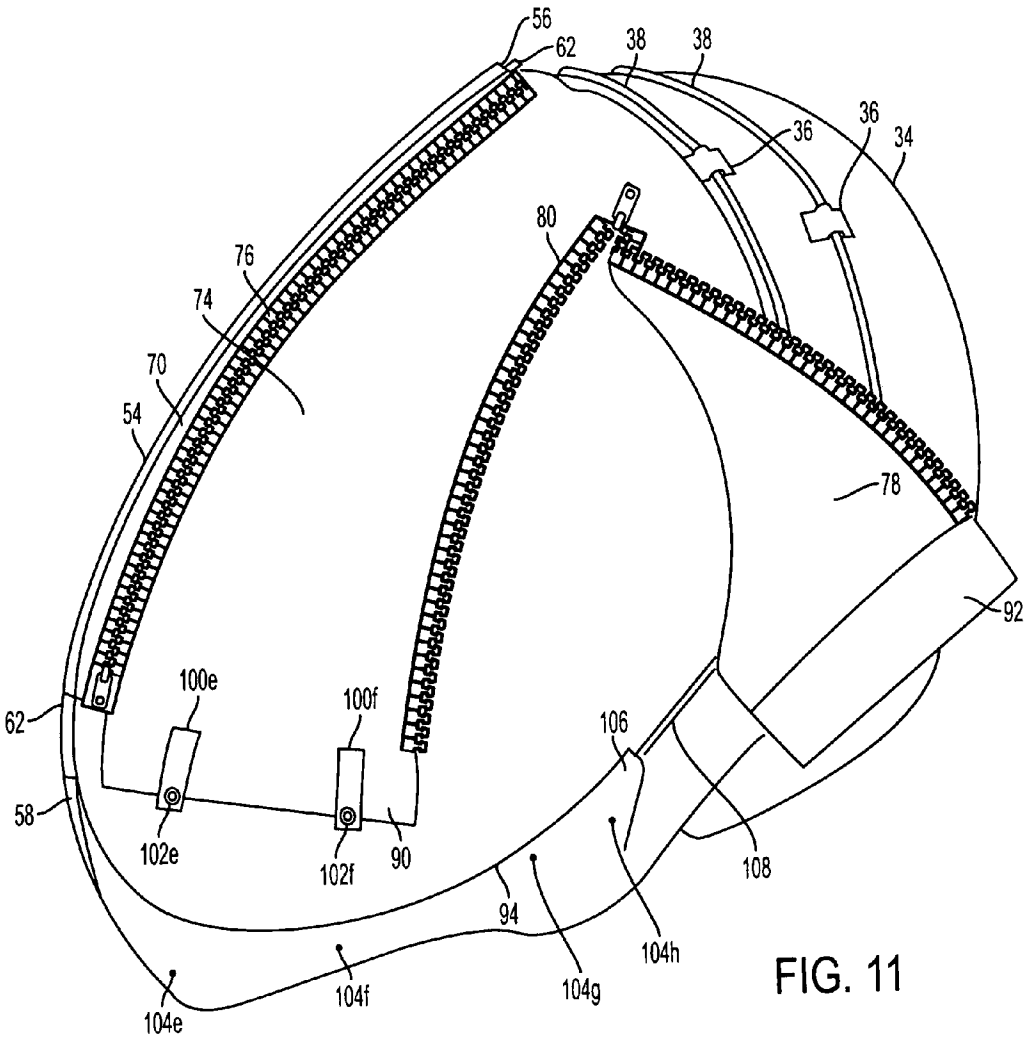
FIG. 11 is an oblique view of the enclosure of FIG. 9, where the enclosure top portion fourth section is opened, and the third and fourth sections are unfastened from the enclosure bottom portion.

As further shown in FIG. 9, the first section has a downwardly extending skirt 84, the second section has a downwardly extending skirt 86, and the center section has a downwardly extending skirt 88. FIG. 11 depicts the third section 74 downwardly extending skirt 90, and the fourth section has a downwardly extending skirt 92.

The enclosure bottom portion 34 has an upper edge 94 and eight male fastener members 104*a–h*. The enclosure top portion 50 first section 64 has two straps 100*a–b* extending downwardly, each strap having a female fastener member 102*a–b* positioned such that when the first section skirt 84 is tucked behind the bottom portion upper edge 94, the straps extend over the bottom portion upper edge such that the female fastener members are fastenable to two of the male fastener members 104*a–b*. Similarly, two straps 100*c–d* with female fastener members 102*c–d* extend from the top portion second section 66 to fasten with male fastener members 104*c–d*, two straps 100*e–f* with female fastener members 102*e–f* extend from the top portion third section 74 to fasten with male fastener members 104*e–f*, and two straps 100*g–h* with female fastener members 102*g–h* extend from the top portion fourth section to fasten with male fastener members 104*g–h*.

When the top portion 50 and bottom portion 52 of the enclosure 32 are drawn together in this manner, the center section skirt 88 is also tucked behind the bottom portion upper edge 82, allowing the top and bottom portion sheathes 54,58 to be aligned such that the rod 62 moves from the top sheath to the bottom sheath.

Figure 10:
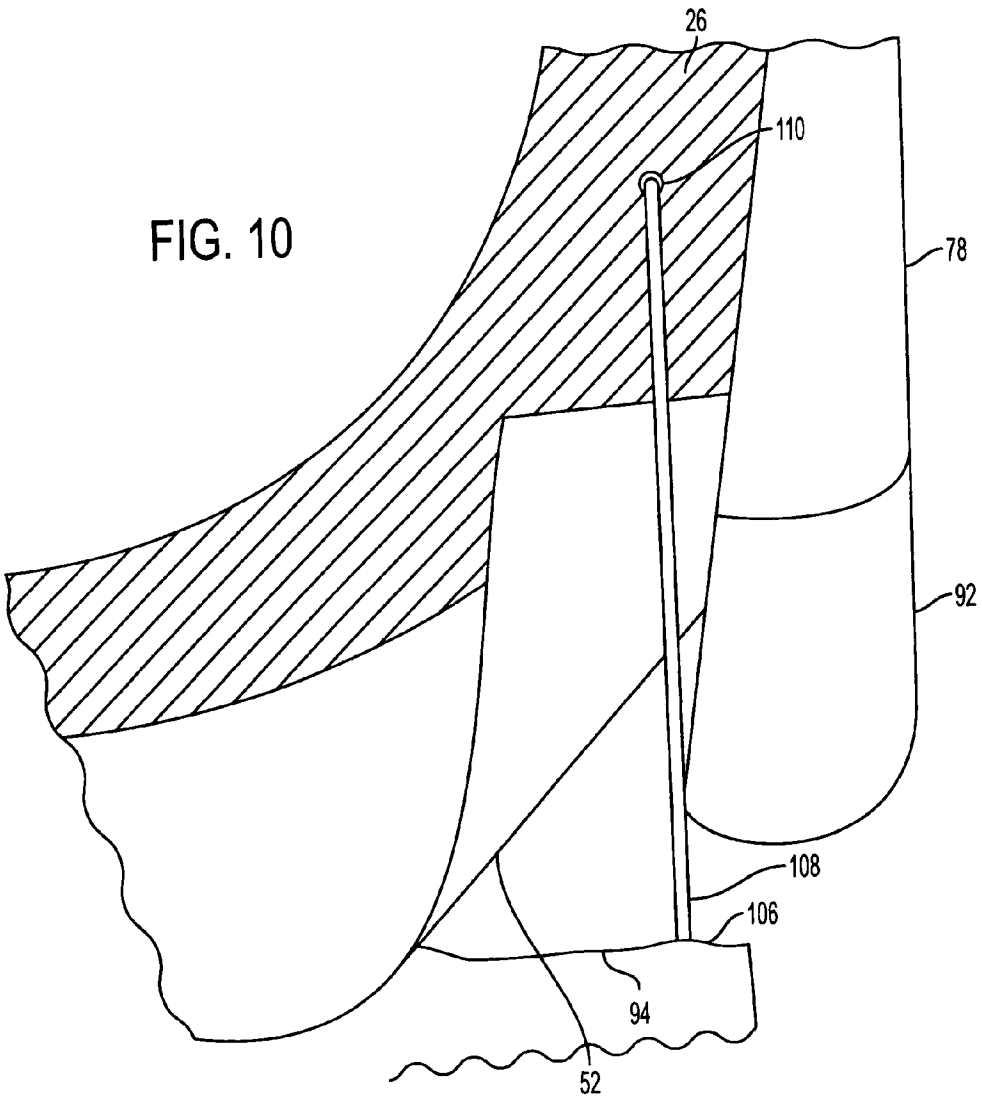
FIG. 10 is an enlarged view of a portion of the enclosure of FIG. 8, where the second flexible rod is shown as it enters a heat exchanger flange bolt hole, the configuration being the same on both sides.

In this exemplary embodiment of the present invention, the enclosure bottom portion upper edge 94 is a sleeve 106 into which is inserted another flexible frame rod 108. This second rod is positioned in a generally horizontal position, and generally perpendicular to the first rod 62. The second rod is sufficiently rigid that it need not be brought to bear against the openable end 14 of the heat exchanger frame. However, in this exemplary embodiment, and as depicted in FIG. 10, the length of the second rod is chosen such that its ends extend from the enclosure bottom portion upper edge sleeve at both ends and each end is inserted into a flange bolt hole 110 left open by the removal of the heat exchanger frame end 12. The tendency of the bent second rod to straighten causes the rod portions proximate the rod ends to bear against the flange bolt holes and remain in place, thus supporting the enclosure bottom portion along its upper edge.

With the flexible frame rods 62,108 in place, the flexible material of the enclosure 30 forms a housing having a substantially clear interior for cleaning tool manipulation and movement during the cleaning operation. The frame rods prop and extend the top and bottom portions to form the interior and prevent them form undue sagging.

Figure 8:
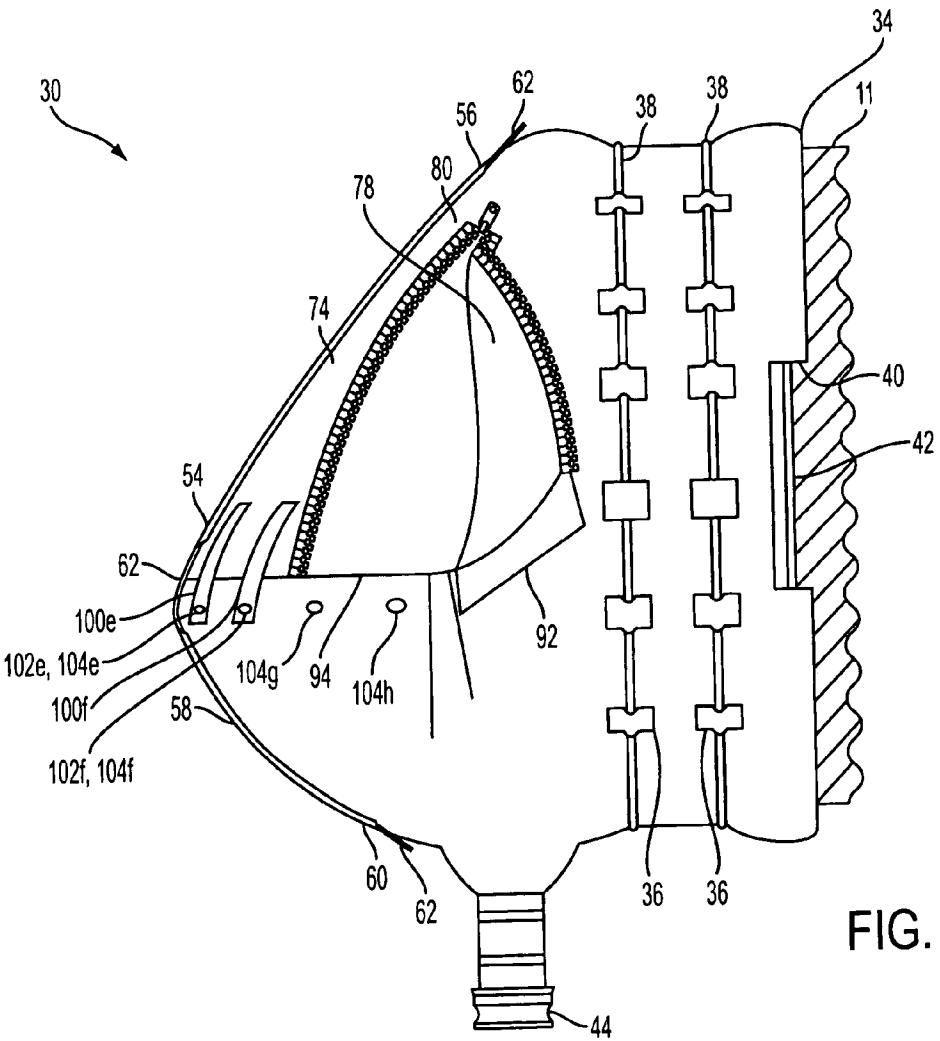
FIG. 8 is side view of the enclosure of FIG. 7, with the enclosure top portion fourth section open.

Referring now to FIG. 8, the enclosure 32 fourth section 78 is shown folded in a rearward direction after the fourth zipper 80 has been unzipped, and the straps have been unfastened from the male fastener members 104*g*, 104*h*. By opening the fourth section in this manner the portion of the fin tube first ends on the far right hand side of the frame 16 are exposed for direct access and insertion of the cleaning tool into such fin tube first ends. While the operator can possibly cause the cleaning tool to reach other fin tube first ends, such access is not direct, in that the tool would not be directly alignable with such other fin tube first ends, as the tool is with respect to the fin tube first ends exposed by the opened fourth section. Since the fin tubes for this type of heat exchanger are U-tubed, the cleaning liquids and dislodged materials from the fin tubes at the far right are discharged at the far left side of the heat exchanger frame, where they primarily strike the enclosure top portion first and second sections, which remain closed. Thus, the cleaning liquid and dislodged materials are contained within the enclosure and are directed to the drain 44 on the enclosure bottom portion 52. Similarly, the cleaning liquid will occasionally splash or drain back from the fin tube first end, where they are also contained by the enclosure and directed to the drain.

Figure 12:
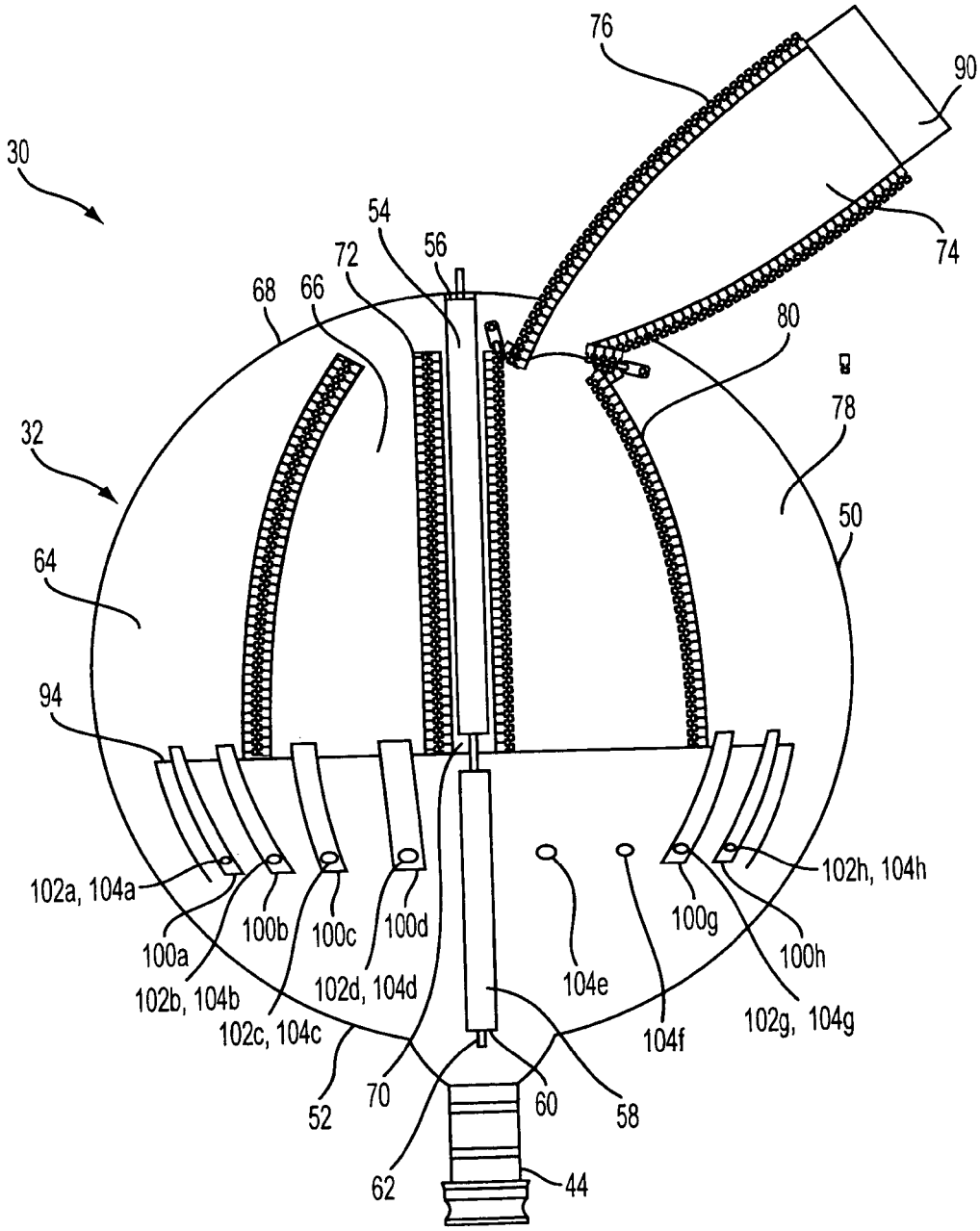
FIG. 12 is an oblique view of the enclosure of FIG. 7, where the enclosure third section is opened.

When all the fin tubes are cleaned that had first ends exposed by the opening of the enclosure top section fourth section 78, the cleaning tool operator again tucks the fourth section skirt 92 behind the enclosure bottom portion upper edge 94, and refastens the male and female fasteners 102*g*, 104*g*. While the fourth zipper 80 remains unzipped, the operator opens the third zipper 76 and unfastens the male and female fastener members 102*e*, 102*f* on third section straps 100*e*, 100*f*. The third section may then be folded out of the way, as shown in FIG. 12, while the first, second, center and fourth sections all remain in place. The remaining fin tube first ends on the near right side of the heat exchanger frame are thus exposed for direct insertion of the cleaning tool into such fin tube first ends. The cleaning fluid and dislodged material is routed through the U-tubed fin tubes and discharged from the near left side of the heat exchanger frame, where they primarily strike the enclosure top portion first, second and center sections. Such cleaning fluid and dislodged material falls to the enclosure bottom portion 52 where they are directed to the bottom portion drain 44. Splashback fluids from the fin tube first ends are also contained and directed to the drain.

Referring now to FIG. 10, an alternative method of using the apparatus to gain cleaning tool access to the fin tube ends on the right side of the heat exchanger frame, is shown to include unfastening the male and female fasteners 104*e–h*, 102*e–h* for the enclosure top portion third section 74 and fourth section 78, to allow a partial lowering of the enclosure bottom portion upper edge 94, thus providing even more access to the fin tube ends on the right side of the heat exchanger frame 11, particularly those nearer the bottom. In this method, the fin tube ends on the left side of the heat exchanger frame 11 remain behind the enclosure top portion first, second and center sections.

In the foregoing exemplary embodiment, the operator can choose the side from which to been. Enclosure first and second sections 64,66 allow the operator to use the left side of the heat exchanger frame 11 for cleaning tool insertion, while the third and fourth sections 74,78 block and contain cleaning fluid and dislodged materials as the same are discharged on the right side of the heat exchanger frame.

Figure 4:
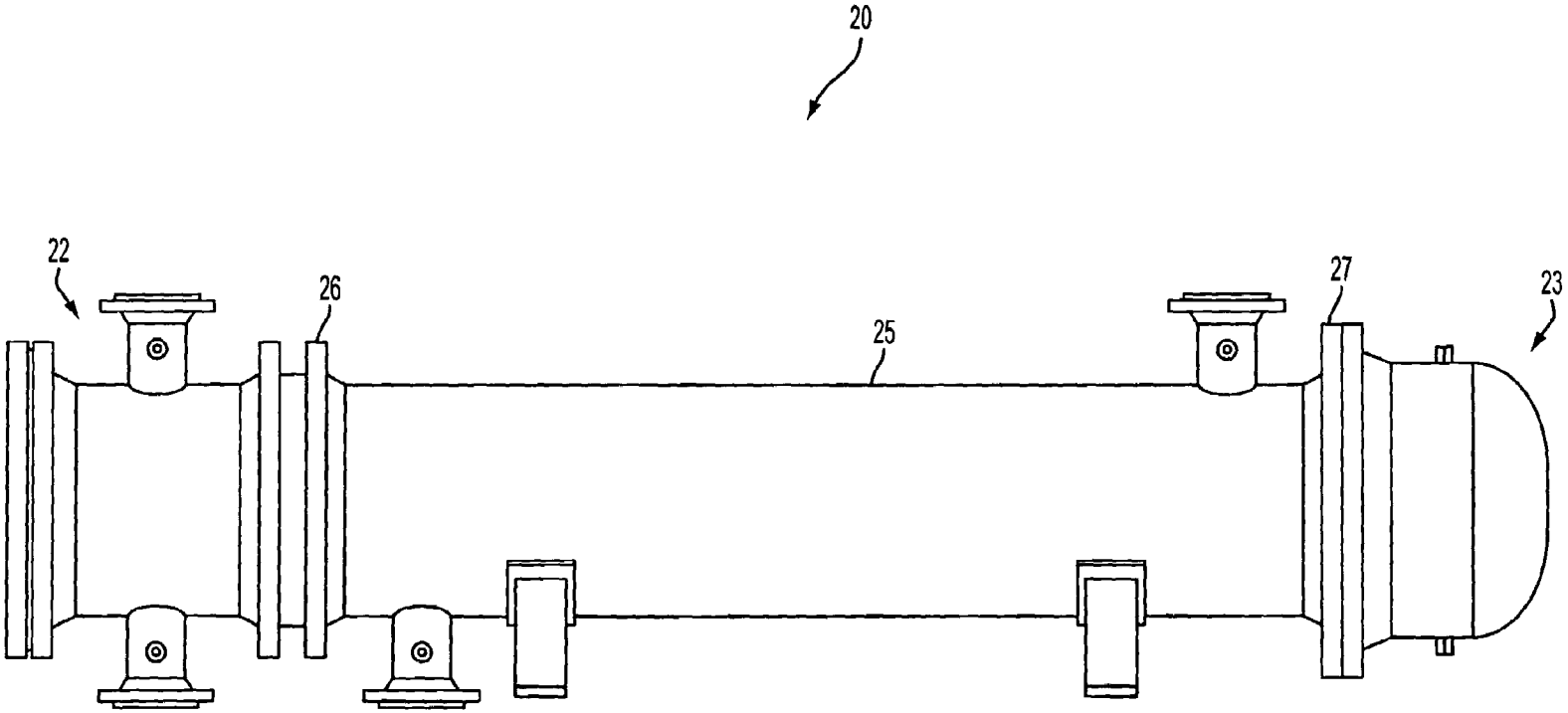
FIG. 4 (PRIOR ART)
FIG. 4 is a side view of a heat exchanger of the type having fin tubes in a straight configuration.
Figure 5:
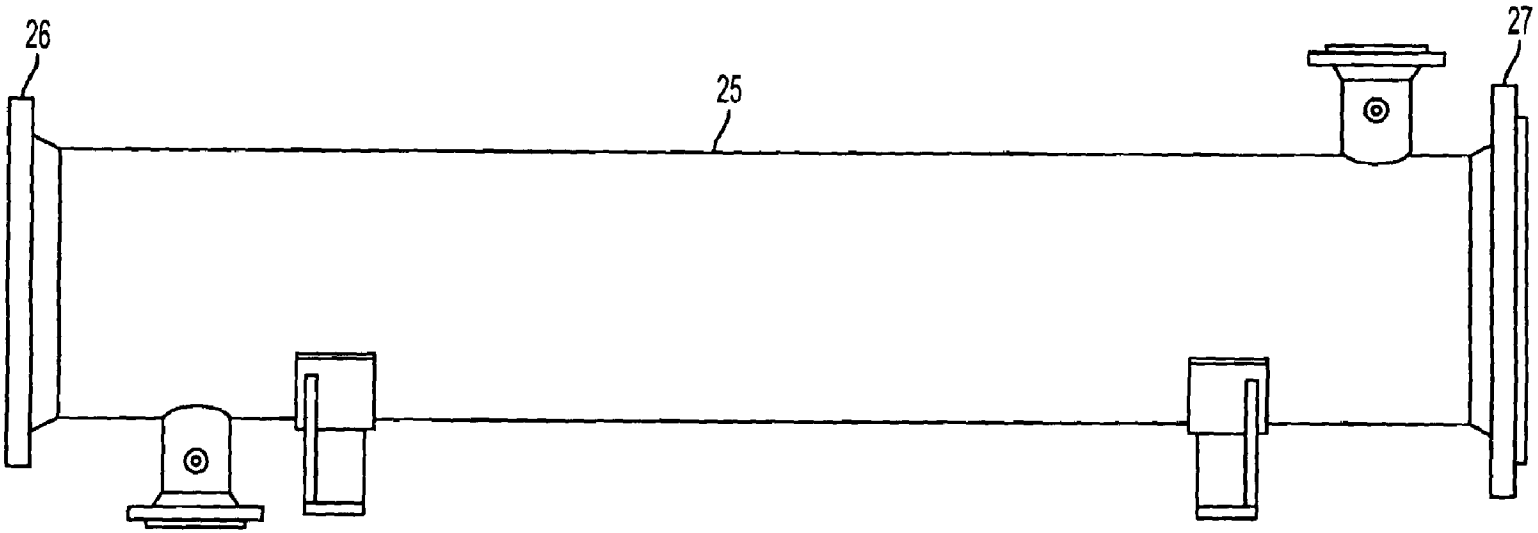
FIG. 5 (PRIOR ART)
FIG. 5 is a side view of the heat exchanger shown in FIG. 4, with the ends removed leaving the shell (frame) within which the fin tubes run from one end to the other.

For cleaning the fin tubes in a heat exchanger 20 of the type shown as prior art in FIGS. 4–5, provision must be made for the discharge of cleaning fluid and dislodged materials from the second end 27 of the heat exchanger shell (frame) 25. In an additional exemplary embodiment, shown in FIG. 13, I have provided a second flexible enclosure 110 having a rear edge 112 that circumvents the opened heat exchanger second end and is attached to such second end by ropes 113 in loops 114 in the same fashion that the first enclosure 30 attached to the U-tube type heat exchanger openable end 14. In this exemplary embodiment, and as further shown in FIG. 13, the rear edge of the second enclosure has a sleeve 120 having a rope 122 therein that can be tightened in drawstring fashion to provide additional attachment integrity with respect to the heat exchanger second end.

The same first enclosure attaches to the opened heat exchanger first end 26 in the same fashion as it did the openable end 14 of the heat exchanger shell (frame) 11.

In this exemplary embodiment, the second enclosure 110 has a housing 124 and a frame having a first flexible member enclosed within a sleeve 126 on the housing and extending in a substantially vertical path from a top point proximate the opened heat exchanger second end 27, around the front of the housing to a bottom point proximate the opened heat exchanger second end. A second flexible frame member 128 is insertable into a sleeve 130 and extends from a left side point proximate the heat exchanger second end, in a generally horizontal direction, around the front of the housing to a right side point proximate the heat exchanger second end. At the end of the horizontal sleeve is a closable flap 132 that doubles back over the flexible frame member 128 and prevents the second flexible frame member from being removed from the horizontal sleeve. The closable flap is opened for insertion of the second flexible frame member and re-closed after insertion. The vertically and horizontally oriented frame members support the flexible housing and prevent an undue amount of sag in the flexible material used for the housing.

In some exemplary embodiments, the closable flap 132 is present at both ends of the horizontal sleeve 130. In another exemplary embodiment, at least one closable flap is present on at least one end of the vertical sleeve 126, allowing removal of the flexible frame member from such sleeve.

Figure 13:
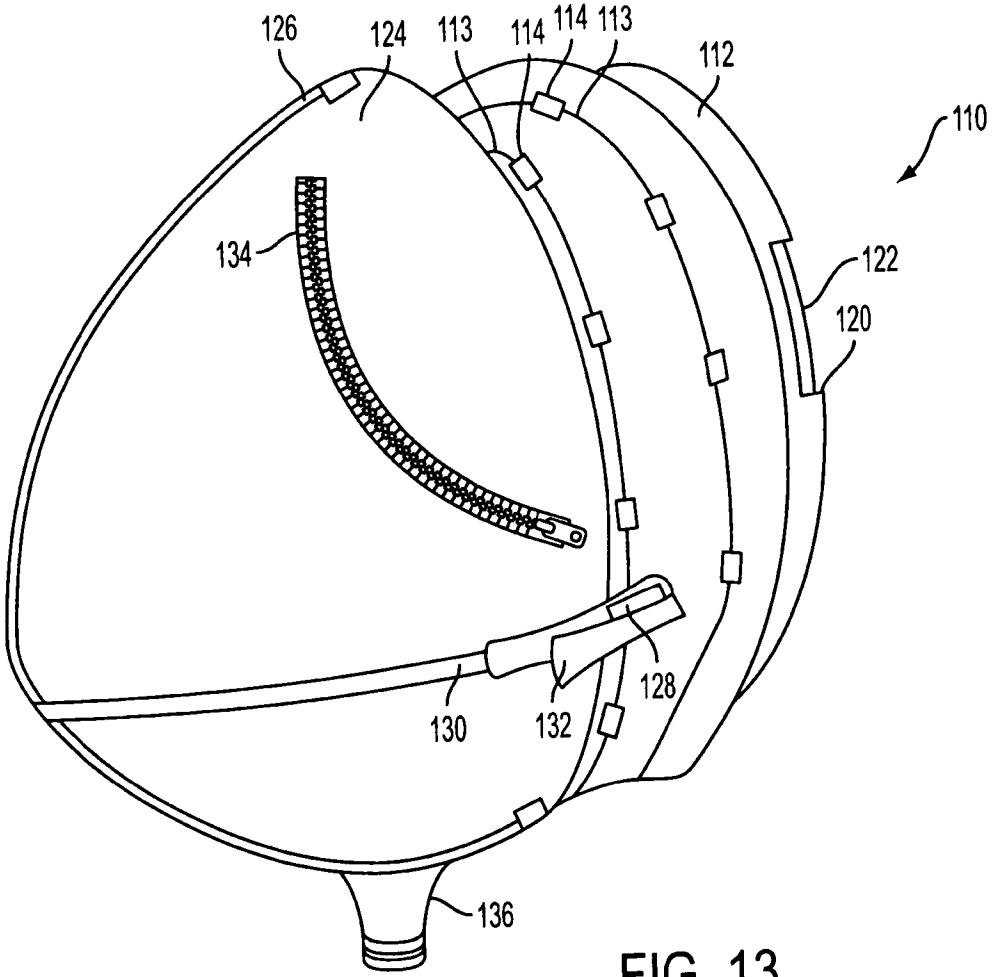
FIG. 13 is an oblique view of an exemplary embodiment of a second enclosure of the present invention.

As shown in FIG. 13, a second enclosure housing right access member 134 is provided, which, in this exemplary embodiment is a zippered slot in the housing material. A corresponding left access member (not shown) is also provided.

In the exemplary embodiment illustrated in FIG. 13, the enclosure 110 is positioned on the heat exchanger 20 second end 27 to capture and retain the cleaning fluids and dislodged materials from the fin tubes while the cleaning tool is introducing the cleaning fluid into the fin tubes at the first end 26 of the heat exchanger frame 25. Captured fluids are directed within the second enclosure 110 to a drain 134.

In the method of cleaning this type of heat exchanger 20 using the first enclosure 30 and the second enclosure 110, the four enclosure top portion sections 64,66,74,78 on the first enclosure 30 are opened singly and in various combinations, as needed to properly expose the fin tubes for cleaning tool insertion, while simultaneously blocking or restricting other fin tube ends at the first end 26. For example, in one exemplary method each section is individually opened to provide direct access to the fin tube ends exposed by such an opening.

In the exemplary embodiments of the present invention of FIGS. 6–13, the flexible material in the enclosures 30,110 are constructed using a coated vinyl (approximately 22 ounces per square yard). The frame rods 62,108 are constructed from fiberglass, and the flexible frame members on the second enclosure are made from flat, elongated wood pieces. The closable flaps for the horizontal and vertical sleeves 130,126 are nylon with hook and pile fasteners of sufficient length to allow adjustable closing positions. The ropes 38,42,113,122 are nylon and the loops 36,114 are nylon.

With respect to the above description then, it is to be realized that the optimum device configuration for the particular situation, will include variations in the device shape, size, and component materials that will occur to those skilled in the art upon review of the present disclosure.

All equivalent relationships to those illustrated in the drawings and described in the specification are intended to be encompassed by the present invention. The descriptions in this specification are for purposes of illustration only and are not to be construed in a limiting sense.

The invention claimed is:

1. For a heat exchanger to be cleaned by a cleaning apparatus having a fluid discharge end, a fluid containment apparatus for attachment to the heat exchanger, the heat exchanger having multiple fin tubes supported by and positioned within a substantially cylindrical frame, the frame having an openable and substantially circular end and each of the fin tubes being U-shaped and having a first end and a second end, such that each fin tube first end and second end is proximate the openable end when the frame is opened, the frame openable end having a removable end member for opening the frame openable end such that the cleaning apparatus fluid discharge end is insertable into one of the fin tube first ends, such that cleaning fluids discharged within the fin tube exits the fin tube's second end, the apparatus comprising:

an enclosure having a frame, a flexible housing, and a drain member, the housing having an interior, the housing being supported by the frame, the housing being extendable over and attachable to the heat exchanger frame opened openable end, the housing having a plurality of access portions, each access portion being openable to expose a number of the fin tube first ends to cleaning apparatus fluid discharge end direct access and entry and cleaning fluid discharged from the cleaning apparatus fluid discharge end, the flexible housing substantially blocking such direct access and entry to the fin tube second ends corresponding to the exposed fin tube first ends, such access portion being closable to substantially block such direct access and entry to such exposed heat exchanger fin tube first ends, the flexible housing being attached such that cleaning fluid discharged from the second end of the fin tube into which the cleaning apparatus discharge end is inserted, is received by the housing and directed by the housing to the drain member.

2. The apparatus of claim 1, wherein the enclosure housing access portions are simultaneously openable such that all fin tube first ends are exposed.

3. For a heat exchanger to be cleaned by a cleaning apparatus having a fluid discharge end, the heat exchanger having multiple fin tubes supported by and positioned within a substantially cylindrical frame, the frame having an openable and substantially circular end and each of the fin tubes being U-shaped and having a first end and a second end, such that each fin tube first end and second end is proximate the openable end when the frame is opened, the frame openable end having a removable end member for opening the frame openable end such that the cleaning apparatus fluid discharge end is insertable into one of the fin tube first ends, such that cleaning fluids discharged within the fin tube exits the fin tube's second end, an apparatus for containing the discharged cleaning fluids comprising:

means for enclosing the opened heat exchanger frame openable end while providing openable separate direct access and entry to each of at least two pluralities of the heat exchanger fin tube first end for the cleaning apparatus fluid discharge end to enter, the means substantially blocking such direct access and entry to the remaining fin tube first end pluralities during such direct access and entry to a first of the pluralities, and to the first of the pluralities during direct access and entry to a second of the pluralities, the means being attached such that cleaning fluid discharged from a fin tube first end and a fin tube second end is received by, and drained from, such means.

4. The apparatus of claim 3, wherein the means for enclosing the opened heat exchanger frame openable end is optionally openable such that all fin tube first ends are exposed for direct access and entry by the cleaning apparatus fluid discharge end.

5. For a heat exchanger to be cleaned by a cleaning apparatus having a fluid discharge end, the heat exchanger having multiple fin tubes supported by and positioned within a substantially cylindrical frame, the frame having an openable and substantially circular end and each of the fin tubes being U-shaped and having a first end and a second end, such that each fin tube first end and second end is proximate the openable end when the frame is opened, the frame openable end having a removable end member for opening the frame openable end such that the cleaning apparatus fluid discharge end is insertable into one of the fin tube first ends, such that cleaning fluids discharged within the fin tube exits the fin tube's second end, a method for containing the discharged cleaning fluids comprising:

enclosing the opened heat exchanger frame openable end with an enclosure;

opening a first access portion of the enclosure to expose a first plurality of the fin tube first ends to cleaning apparatus fluid discharge end direct access and entry, and cleaning fluid discharged from the cleaning apparatus fluid discharge end, the enclosure substantially blocking such direct access and entry to at least one additional plurality of fin tube first ends;

discharging cleaning fluid from the cleaning apparatus fluid discharge end into each of the first plurality of fin tube first ends, the enclosure capturing and draining cleaning fluid discharged from the fin tubes proximate the fin tube second ends and the first plurality fin tube first ends;

closing the first access portion;

opening a second access portion of the enclosure to expose a second plurality of the fin tube first ends to cleaning apparatus fluid discharge end direct access and entry, and cleaning fluid discharged from the cleaning apparatus fluid discharge end, the enclosure substantially blocking such direct access and entry to at least some of the first plurality of fin tube first ends; and discharging cleaning fluid from the cleaning apparatus fluid discharge end into the second plurality of fin tube first ends, the enclosure capturing and draining cleaning fluid discharged from the fin tubes proximate the fin tube second ends and the second plurality fin tube first ends.

6. For a heat exchanger to be cleaned by a cleaning apparatus having a fluid discharge end, a fluid containment apparatus for attachment to the heat exchanger, the heat exchanger having multiple fin tubes supported by and positioned within a substantially cylindrical frame, the frame having a substantially circular first end and second end, the fin tubes each having a first end and a second end, the frame first and second ends each having a removable end member such that the frame first and second ends are openable and such that the cleaning apparatus discharge end is insertable into one of the fin tube first ends, such that cleaning fluids discharged within the fin tube exits the fin tube's second end proximate the frame's opened second end, the apparatus comprising:

a first enclosure having a frame, a flexible housing, and a drain member, the housing having an interior, the housing being supported by the frame, the housing being extendable over and attachable to the opened heat exchanger frame openable first end, the housing having a plurality of access portions, each access portion being openable to expose a number of the fin tube first ends to cleaning apparatus fluid discharge end direct access and entry and cleaning fluid discharged from the cleaning apparatus fluid discharge end, the flexible housing substantially blocking such direct access and entry to the remaining fin tube first ends, such access portion being closable to substantially block such direct access and entry to the such exposed fin tube first ends, the flexible housing being attached such that cleaning fluid discharged from a fin tube first end is received by the housing and directed by the housing to the drain member; and a second enclosure having a frame, a housing, and a drain member, the housing having an interior, the housing being supported by the frame, the housing being extendable over and attachable to the opened heat exchanger frame openable second end such that cleaning fluid exiting one or more of the fin tube second ends is received by the second enclosure housing and directed by the second enclosure housing to the drain member.

7. The apparatus of claim 6, further comprising an access mechanism for providing access to the second enclosure housing interior, the access mechanism being openable and closable.

8. The apparatus of claim 7, wherein the first enclosure housing access portions are simultaneously openable such that all fin tube first end holes are exposed.

9. For a heat exchanger to be cleaned by a cleaning apparatus having a fluid discharge end, the heat exchanger having multiple fin tubes supported by and positioned within a substantially cylindrical frame, the frame having a substantially circular first end and second end, the fin tubes each having a first end and a second end, the frame first and second ends each having a removable end member such that the frame first and second ends are openable and such that the cleaning apparatus discharge end is insertable into one of the fin tube first ends, such that cleaning fluids discharged within the fin tube exits the fin tube's second end proximate the frame's opened second end, an apparatus for containing the discharged cleaning fluids comprising:

means for enclosing the opened heat exchanger frame openable first end while providing openable separate direct access and entry to each of at least two pluralities of the heat exchanger fin tube first ends for the cleaning apparatus fluid discharge end to enter, the means substantially blocking such direct access and entry to the remaining fin tube first end pluralities during such access and entry to a first of the pluralities, and to the first of the pluralities during direct access and entry to a second of the pluralities, the means being attached such that cleaning fluid discharged from a fin tube first end is received by, and drained from, such means; and means for enclosing the opened heat exchanger frame openable second end such that cleaning fluid exiting one or more of the fin tube second ends is received by, and drained from such means.

10. The apparatus of claim 9, wherein the means for enclosing the opened heat exchanger openable second end has an interior, such means further comprising means for providing access to such interior, such means for providing access being openable and closable.

11. The apparatus of claim 9, wherein the means for enclosing the frame first end is optionally openable such that all fin tube first ends are exposed for direct access and entry by the cleaning apparatus fluid discharge end.

12. For a heat exchanger to be cleaned by a cleaning apparatus having a fluid discharge end, the heat exchanger having multiple fin tubes supported by and positioned within a substantially cylindrical frame, the frame having a substantially circular first end and second end, the fin tubes each having a first end and a second end, the frame first and second ends each having a removable end member such that the frame first and second ends are openable and such that the cleaning apparatus discharge end is insertable into one of the fin tube first ends, such that cleaning fluids discharged within the fin tube exits the fin tube's second end proximate the frame's second end, a method for containing the discharged cleaning fluids comprising:

enclosing the opened heat exchanger frame openable first end with a first enclosure;

enclosing the opened heat exchanger frame openable second end with a second enclosure;

opening a first access portion of the first enclosure to expose a first plurality of the fin tube first ends to cleaning apparatus fluid discharge end direct access and entry and cleaning fluid discharged from the cleaning apparatus fluid discharge end, the first enclosure substantially blocking such direct access and entry to at least one additional plurality of fin tube first ends;

discharging cleaning fluid from the cleaning apparatus fluid discharge end into each of the first plurality of fin tube first ends, the first enclosure capturing and draining cleaning fluid discharged from the fin tubes proximate the first plurality fin tube first ends, the second enclosure capturing and draining cleaning fluid discharged from the fin tubes proximate the first plurality fin tube second ends;

closing the first access portion;

opening a second access portion of the enclosure to expose a second plurality of the fin tube first ends to cleaning apparatus fluid discharge end direct access and entry, and cleaning fluid discharged from the cleaning apparatus fluid discharge end, the enclosure substantially blocking such direct access and entry to at least some of the first plurality of fin tube first ends; and discharging cleaning fluid from the cleaning apparatus fluid discharge end into the second plurality of fin tube first ends, the first enclosure capturing and draining cleaning fluid discharged from the fin tubes proximate the second plurality fin tube first ends, the second enclosure capturing and draining cleaning fluid discharged from the fin tubes proximate the second plurality fin tube second ends.

* * * * *